United States Patent [19]

Fishbein

[11] 4,035,948

[45] July 19, 1977

[54] MUSICAL TOY

[75] Inventor: Harry Fishbein, New York, N.Y.

[73] Assignee: Swisstone Corporation, New York, N.Y.

[21] Appl. No.: 701,182

[22] Filed: June 30, 1976

[51] Int. Cl.[2] ..... A63H 5/00

[52] U.S. Cl. ..... 46/189; 84/95 C

[58] Field of Search ..... 46/52, 175 R, 189, 192; 84/94 C, 95 C

[56] References Cited

U.S. PATENT DOCUMENTS

| | | | |
|---|---|---|---|
| 2,550,991 | 5/1951 | Goodman et al. | 84/95 C |
| 2,630,655 | 3/1953 | Duncan | 46/175 R |
| 2,831,291 | 4/1958 | Muessel | 46/175 R |
| 2,908,997 | 10/1959 | Handler | 84/94 C |

*Primary Examiner*—John F. Pitrelli
*Assistant Examiner*—Robert F. Cutting
*Attorney, Agent, or Firm*—Lewis H. Eslinger

[57] ABSTRACT

The musical toy consists of a body which contains a music box movement of the "left-right music movement" type that is normally operative to produce the desired melody in either direction of rotation of its drive shaft. The movement is fixed to the interior of the hollow body for rotation therewith and means are connected to the drive shaft to hold the shaft against rotation. As a result, when the body is rotated it turns the music movement with respect to the non-rotating drive shaft and produces the desired musical melody. The melody is produced regardless of the direction of rotation of the body of revolution.

12 Claims, 7 Drawing Figures

MUSICAL TOY

The present invention relates to musical toys, and in particular to a musical toy including a music box movement which is readily operated by a small child or infant.

Music box movements of various types are known for use in creating musical notes and sounds for reproduction of simple musical pieces. These instruments are often used by children in various types of toys with which they play. Many such music boxes are driven by a shaft or crank which is hand wound or rotated by the child in order to rotate the conventional peg cylinder that operates the conventional key or tone board in the music box. Certain music boxes of this type include a conventional, albeit somewhat complex, transmission mechanism which allows the peg cylinder to be rotated in the desired direction for producing the desired musical melody or piece, regardless of the direction of rotation of the crankshaft.

The difficulty with these previously proposed devices is that the drive shaft must be manually rotated by the child. This is a difficult operation for an infant to perform; and thus previously proposed music box toys have only been satisfactory for use by older children. While some musical toys suitable for use by infants have been proposed, these typically have simple noisemakers in simple containers or enclosures and operate more or less as rattles. They do not produce a predetermined musical melody or piece.

Accordingly, it is an object of the present invention to provide a toy for use by an infant which will allow the infant to operate a music box movement that produces a predetermined musical melody.

Yet another object of the present invention is to provide a toy which will produce a predetermined muscial melody regardless of the direction in which the toy is moved.

A further object of the present invention is to provide a toy which is adapted to be mounted on another object that can be moved, such as for example a carriage or the like, and produce a predetermined musical melody regardless of the direction of the movement of the carriage.

A further object of the present invention is to provide a toy which will produce a predetermined musical melody, and which is relatively simple in construction and durable in operation.

In accordance with one embodiment of the present invention the musical toy consists of a hollow cylinder having end portions and containing a music box movement rigidly mounted therein for rotation with the cylinder. The music box movement has a drive shaft located along the longitudinal axis of the cylinder and is of the "left-right music movement" type. This phrase "left-right music movement" refers to the type of musical movement which is operative to provide the desired melody from the peg cylinder and keyboard contained within the movement, regardless of the direction in which the drive shaft is rotated.

The toy is provided with a handle or grip element that is operatively connected to the cylinder to permit the cylinder to be rotated on the handle about the cylinder's longitudinal axis. The drive shaft of the music movement is rigidly secured to this handle so that the drive shaft is held against rotation by the handle. By this arrangement when the infant holds the handle of the toy and rolls the cylinder on a surface, such as its crib or play pen, rotation of the cylinder will cause the music box movement to rotate about the drive shaft and produce the desired melody regardless of the direction of rotation of the cylinder, and even when the movement is of the type usually performed by infants with rapid alternating back and forth strokes.

The above, and other objects, features and advantages of this invention will be apparent in the following detailed description of an illustrative embodiment thereof, which is to be read in connection with the accompanying drawings, wherein:

FIG. 4 is a perspective view of another embodiment of the present invention attached to a toy carriage or the like;

Figure 1:
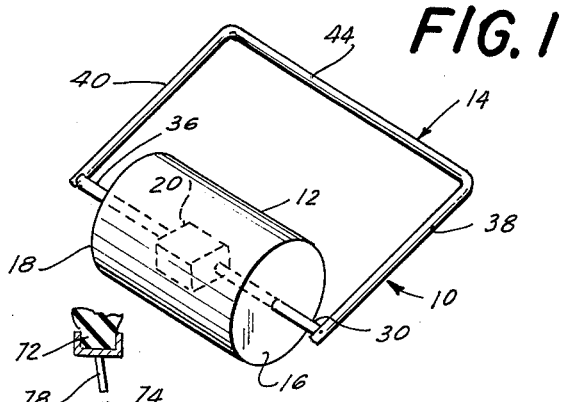
FIG. 1 is a perspective view of a musical toy constructed in accordance with the present invention.

Referring now to the drawing in detail, and initially to FIG. 1 thereof, it will be seen that the musical toy 10, according to one embodiment of the present invention, includes a body of revolution 12, (in this embodiment a cylinder) to which a handle or grip 14 is operatively connected. As described hereinafter the body of revolution 12 contains a music box movement of the "left-right music movement" type, so that when cylinder 12 is rolled along a surface in either direction for rotation about its longitudinal axis, the music box movement will produce a predetermined musical melody.

The term "body of revolution" as used in this specification is intended to mean any shape such as a cylinder, sphere, ellipse, or the like which is adapted to roll along a surface.

Figure 2:
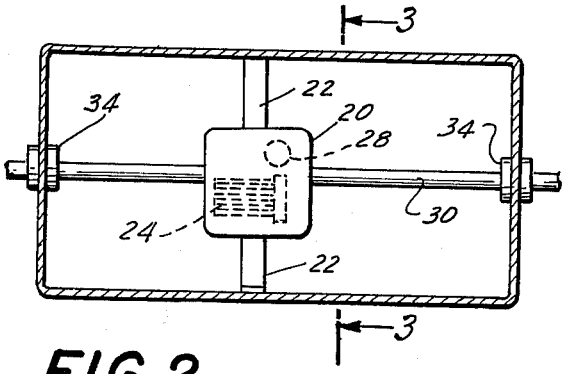
FIG. 2 is a sectional view taken along line 2—2 of FIG. 1.

As seen in FIG. 2 cylinder 12 is hollow, and has a pair of end portions 16, 18. A music box movement 20, of conventional construction, and being of the "left-right music movement" type, is rigidly mounted within cylinder 12, in any convenient manner (as for example by the web elements 22) to rotate with the cylinder. The music box movement includes a conventional keyboard 24, a peg cylinder 26, and a transmission arrangement 28 of known construction for rotating the peg cylinder 26 in the desired direction regardless of the direction of rotation of the input to the transmission 28.

Transmission 28 includes a shaft 30 extending from one of the gears (typically a worm gear) in the transmission. In the illustrative embodiment of the invention shaft 30 extends through the music box movement housing 32 to both ends of the cylinder 12. However, it is contemplated that the shaft need only extend through one end of the cylinder with the other shaft on the opposite side of the music box movement simply being a fixed rod or the like.

In any case, shaft 30 is located along the axis of rotation of the body of revolution 12, which in the illustrative embodiment is the longitudinal axis of the cylinder. The shaft extends through the ends 16, 18 of the cylinder and the cylinder is rotatable with respect to the shaft. To this end bearing elements 34 may be provided in the end walls of the cylinder for permitting relative rotation of the cylinder with respect to shaft 30.

The free ends 36 of shaft 30 are fixed in any convenient manner against rotation in the leg portions 38, 40 of the generally U-shaped handle member 14. Thus the shaft is held against rotation with respect to the handle.

Finally, the exterior surface of the cylinder 12 may be covered with any suitable material such as sponge rubber and a fabric coating to make the surface smooth and comfortable for use by an infant.

Figure 3:
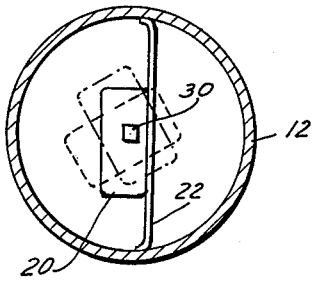
FIG. 3 is a sectional view taken along line 3—3 of FIG. 2.

By this arrangement, the infant can hold the toy by the bight portion 44 of handle 14 and roll the cylinder 12 along any play surface. Rotation of the cylinder will cause the music box movement within the cylinder to rotate with it, as shown by the dotted lines in FIG. 3. At the same time however the shaft 30 is held against rotation by handle 14. The relative movement of the transmission 28 of the music box movement with respect to the fixed shaft will cause the elements of the movement to rotate, and thus cause the peg cylinder 26 to rotate in the desired direction to produce a musical melody in cooperation with the keyboard 24. Because of the transmission arrangement used in a "left-right music movement" type music box, the desired musical melody will be produced regardless of the direction of the rotation of the cylinder. Thus the infant child can roll the cylinder in any direction, including successive back and forth movements, and continuously produce the desired melody. Accordingly, the device is useful even by a small child, and produces a more pleasing sound than a conventional rattle type toy previously used as a toy for infants.

Figure 4:
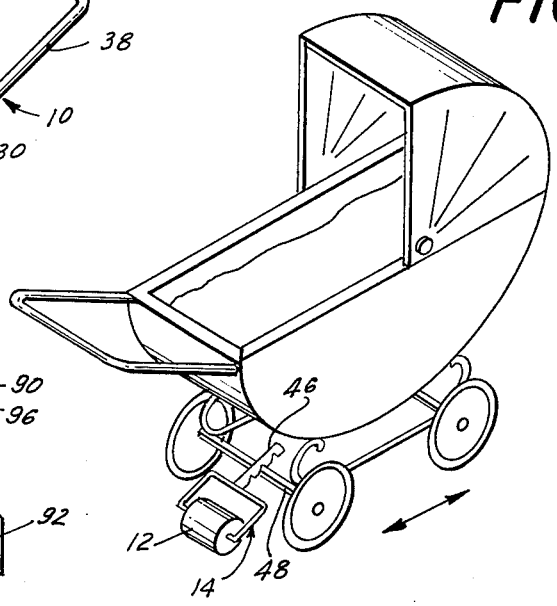

In accordance with another feature of the invention the toy can be attached to another object to produce the desired musical melody. As illustrated in FIG. 4, handle 14 can be provided with an extension or connecting rod 46 which will secure the toy to a wheel shaft or other portion 48 of a toy carriage.

In a typical carriage the wheel shaft 48 is fixed and the wheels of the carriage simply rotate on the shaft.

In the presently preferred embodiment, the extension 46 of the toy is secured to handle 14 in any convenient manner and has a plurality of notches 50 formed therein for snap fitting over the shaft 48 of the carriage. The notches can be provided in different dimensions in spaced relation to each other to allow the toy to accommodate carriages of different sizes. With the toy properly in position so that cylinder 12 will roll on the ground over which the carriage moves, the toy will produce a musical melody regardless of the direction in which the carriage is strolled, and even when the carriage is moved slightly back and forth in the typical rocking motion used to soothe infants in a carriage.

Previously proposed music box movements for use with carriages or other movable objects required separate winding of the movement in order for the movement to operate. This is a time consuming and inexpedient operation, and for this reason the music box movement often is not used. With the present invention on the other hand, the music box is automatically operated as the carriage is strolled and no winding is required.

Figure 5:
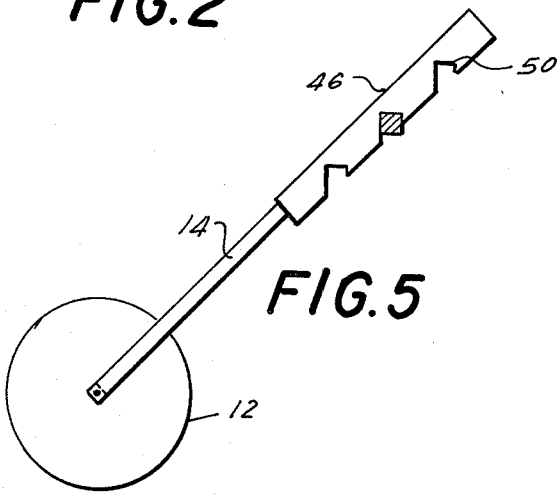
FIG. 5 is a side view of the musical toy illustrated in FIG. 4.
Figure 6:
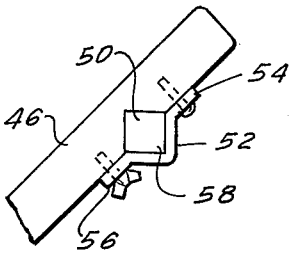
FIG. 6 is a partial side view similar to FIG. 4 of another embodiment of the invention.

As an alternative to the snap fitting arrangement for the connector 46, as illustrated in FIG. 5, a clamping mechanism 52 of any convenient construction can be used to removably secure the connector rod 46 to the carriage wheel shaft or any other convenient portion of the carriage to which the connector rod can be secured. This clamp arrangement 52 can simply consist of a metal strap secured at its ends 54, 56 by screws or the like into the connector 46. This forms an opening 58 cooperating with the slots 50 of the connecting rod in which the wheel shaft of the carriage can be accommodated.

Figure 7:
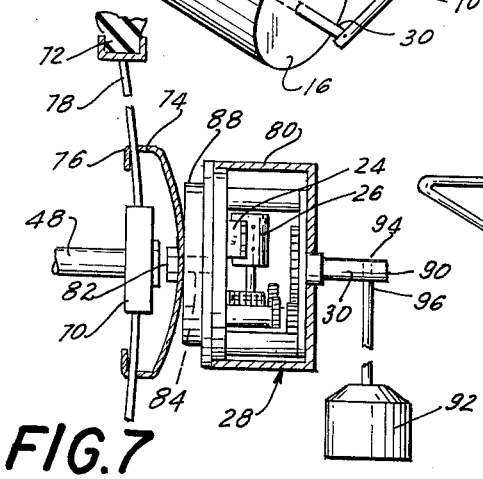
FIG. 7 is a sectional view of yet another embodiment of the present invention.

A further embodiment of the invention is illustrated in FIG. 7. The figure illustrates, in section, the hub 70 of a spoked wheel 72 such as is conventionally used with toy baby carriages. The hub is rotatable on the fixed shaft 48 of the carriage in the conventional manner and is covered by a hub cap 74 having tabs 76 which are bent over wheel spokes 78, also in the conventional manner, to secure the hub cap to the wheel. In this embodiment of the invention a hollow housing 80, which is illustrated as being cylindrical but which may take any desired shape, is fixed to the hub cap 74 for rotation therewith. This can be done, as shown in FIG. 7, by using a bolt 82 having a threaded stem 84 extended through an aperture 86 in the hub cap and threadably secured in the base 88 of the housing 80.

A "left-right" music movement 20 is mounted on base 88 in any known manner and, as in the prior embodiments, includes a key board 24, peg cylinder 26 and transmission 28. The transmission is drivingly connected through one or more gears to the drive shaft 30 of the music movement. This shaft extends outwardly through housing 80 and is rotatably mounted therein on an axis aligned with the axis of shaft 48 and the axis of rotation of housing 80 to permit relative rotation therebetween.

Shaft 30, in this embodiment, has a free end 90 to which a relatively heavy weight 92 is secured. In the illustrative embodiment the end 90 of shaft 30 has a threaded hole 94 formed therein perpendicularly of the shaft, which threadably receives the threaded end 96 of weight 92.

By this arrangement, when the carriage is moved wheel 72 rotates and thus the housing 80 and music movement therein rotate with it. However since the weight 92 is secured to shaft 30 the shaft is prevented from rotating with housing 80 and is held in a relatively fixed position. Thus, with shaft 30 held fixed and the music movement is rotated with respect to the shaft; and the transmission system, which is drivingly engaged with the shaft, but which itself rotates en masse with housing 80, is operated to turn the peg wheel 26. This occurs regardless of the direction of rotation of wheel 72 and produces the desired melody.

Accordingly it is seen that a relatively simply constructed musical toy is provided which can be used by a small child or infant, to produce a desired musical melody regardless of the direction in which the toy is operated. In addition an arrangement is provided for producing a musical melody in connection with a carriage without the need for winding a separate music box movement.

Although an illustrative embodiment of the present invention has been described herein with reference to the accompanying drawings, it is to be understood that the invention is not limited to that precise embodiment thereof but that various changes and modifications may be effected therein by one skilled in the art without departing from the scope or spirit of this invention.

What is claimed is:

1. A musical toy comprising, a hollow body; a music box movement mounted in said body for rotation therewith; said music box movement having a drive shaft and being of the "left-right music movement" type operative to produce the desired melody in either direction of rotation of the drive shaft; said drive shaft extending from said music box movement along an axis of rotation of said body and through said body; and means rigidly secured to said drive shaft for holding said shaft against rotation, whereby rotation of said body of revolution about said axis of rotation will cause said music box to rotate about the drive shaft and produce the desired melody regardless of the direction of rotation of said body.

2. The toy as defined in claim 1 wherein said body comprises a body of revolution and said holding means comprises a handle.

3. The toy as defined in claim 2 wherein said body of revolution comprises a cylinder and said drive shaft is located along the longitudinal axis of said cylinder.

4. The toy as defined in claim 3 wherein said cylinder has a pair of opposed end portions and said shaft extends through said music box movement to two free ends passing through said end portions of the cylinder; said handle means comprising a generally U-shaped yoke having a pair of spaced legs respectively connected to said shaft ends to prevent rotation of the shaft with respect to said handle and said cylinder; said cylinder being rotatable with respect to the shaft along its longitudinal axis.

5. The toy as defined in claim 2 including means secured to said handle means for securing said toy to another object in position for the body of revolution to engage a support surface whereby movement of said another object causes rotation of said body of revolution and said toy to produce the desired musical melody.

6. The toy as defined in claim 5 wherein said object is a carriage and said securing means comprises an elongated rod including means for attaching the rod to a wheel shaft of the carriage.

7. The toy as defined in claim 6 wherein said attaching means comprises at least one slot in the rod for snap-fitting the rod on the wheel shaft of the carriage.

8. The toy as defined in claim 1 wherein said holding means comprises a weight secured to said shaft to hold the shaft against rotation during rotation of said body.

9. The toy as defined in claim 8 including means for securing said body to the hub cap of a toy carriage.

10. A musical toy comprising, a hollow cylinder having a pair of end portions; a music box movement rigidly mounted within said cylinder for rotation therewith; said music box movement having a drive shaft located along the longitudinal axis of said cylinder and being of the "left-right music movement" type operative to produce the desired melody in either direction of rotation of the drive shaft; handle means operatively connected to said cylinder to permit the cylinder to rotate on the handle about the cylinder's longitudinal axis; said drive shaft of the music movement being rigidly secured to said handle whereby the drive shaft is held against rotation by the handle while rotation of said cylinder will cause said music box movement to rotate about the drive shaft and produce the desired melody regardless of the direction of rotation of said cylinder.

11. The toy as defined in claim 10 wherein said handle means comprises a generaly U-shaped yoke having a pair of spaced legs respectively located adjacent opposite ends of said cylinder, and a bight portion extending along and spaced from the side wall of the cylinder, parallel to its longitudinal axis.

12. A toy as defined in claim 11 including means secured to said handle means for securing said toy to a wheel shaft of a carriage in position to allow said cylinder to engage a support surface on which the carriage moves whereby movement of the carriage causes rotation of said cylinder and said toy to produce the desired melody regardless of the direction of movement of the carriage.

* * * * *